US005913442A

United States Patent [19]

Wu

[11] Patent Number: 5,913,442

[45] Date of Patent: Jun. 22, 1999

[54] CONTAINER WITH VARIABLE DECORATIVE MEANS

[75] Inventor: Eric Wu, Richardson, Tex.

[73] Assignee: Dyna Chain Industrial Co., Ltd., Taipei Hsien, Taiwan

[21] Appl. No.: 08/877,369

[22] Filed: Jun. 17, 1997

[51] Int. Cl.[6] ..... B65D 25/10

[52] U.S. Cl. ..... 220/62.15; 220/469; 220/8; 220/666; 206/457; 206/459.5

[58] Field of Search ..... 220/469, 470, 220/8, 666, 62.15; 206/457, 459.5

[56] References Cited

U.S. PATENT DOCUMENTS

| | | | |
|---|---|---|---|
| 3,930,702 | 1/1976 | Pichowicz | 206/457 |
| 5,525,383 | 6/1996 | Witkowski | 206/457 |
| 5,582,293 | 12/1996 | Kay | 206/457 |
| 5,718,336 | 2/1998 | Haarlander | 206/457 |

*Primary Examiner*—Joseph M. Moy
*Attorney, Agent, or Firm*—Bacon & Thomas

[57] ABSTRACT

A container including a container body decorated with a drawing, a hollow shell sleeved onto the container body and defining an enclosed space around the container body; and a telescopic decorative device mounted around the container body within the enclosed space and having a plurality of decorative rings that slide one inside another and decorated with a part of a drawing, wherein the decorative rings of the telescopic decorative device are received one inside another and the drawing of the container body is revealed when the container is turned upside down with the top opening facing downwards; the decorative rings of the telescopic decorative device are extended out of one another to show the drawing thereof as a whole when the container is disposed in vertical with said top opening facing upwards.

9 Claims, 4 Drawing Sheets

CONTAINER WITH VARIABLE DECORATIVE MEANS

BACKGROUND OF THE INVENTION

The present invention relates to a container with variable decorative means. The container shows a first drawing when disposed in vertical with its top opening facing upwards, or a second drawing when turned upside down with its top opening facing downwards.

Regular drinking containers, for example, tea cups may be decorated with drawings or signs of the zodiac to attract the consumers. There is also known such a drinking container which is coated with thermochromic material that changes its color when hot. However, a drinking container of this design is expensive.

SUMMARY OF THE INVENTION

It is one object of the present invention to provide a container which shows a first pattern when disposed in vertical with its top opening facing upwards, or a second pattern when turned upside down with its opening facing downwards. It is another object of the present invention to provide a container with variable decorative means which is less expensive and easy to assemble. To achieve these and other objects of the present invention, there is provided a container comprised of a container body decorated with a drawing, a hollow shell sleeved onto the container body and defining an enclosed space around the container body; and a telescopic decorative device mounted around the container body within the enclosed space and having a plurality of decorative rings that slide one inside another and decorated with a part of a drawing, wherein the decorative rings of the telescopic decorative device are received one inside another and the drawing of the container body is revealed when the container is turned upside down with the top opening facing downwards; the decorative rings of the telescopic decorative device are extended out of one another to show the drawing thereof as a whole when the container is disposed in vertical with said top opening facing upwards.

DETAILED DESCRIPTION OF THE PREFERRED EMBODIMENT

Figure 1:
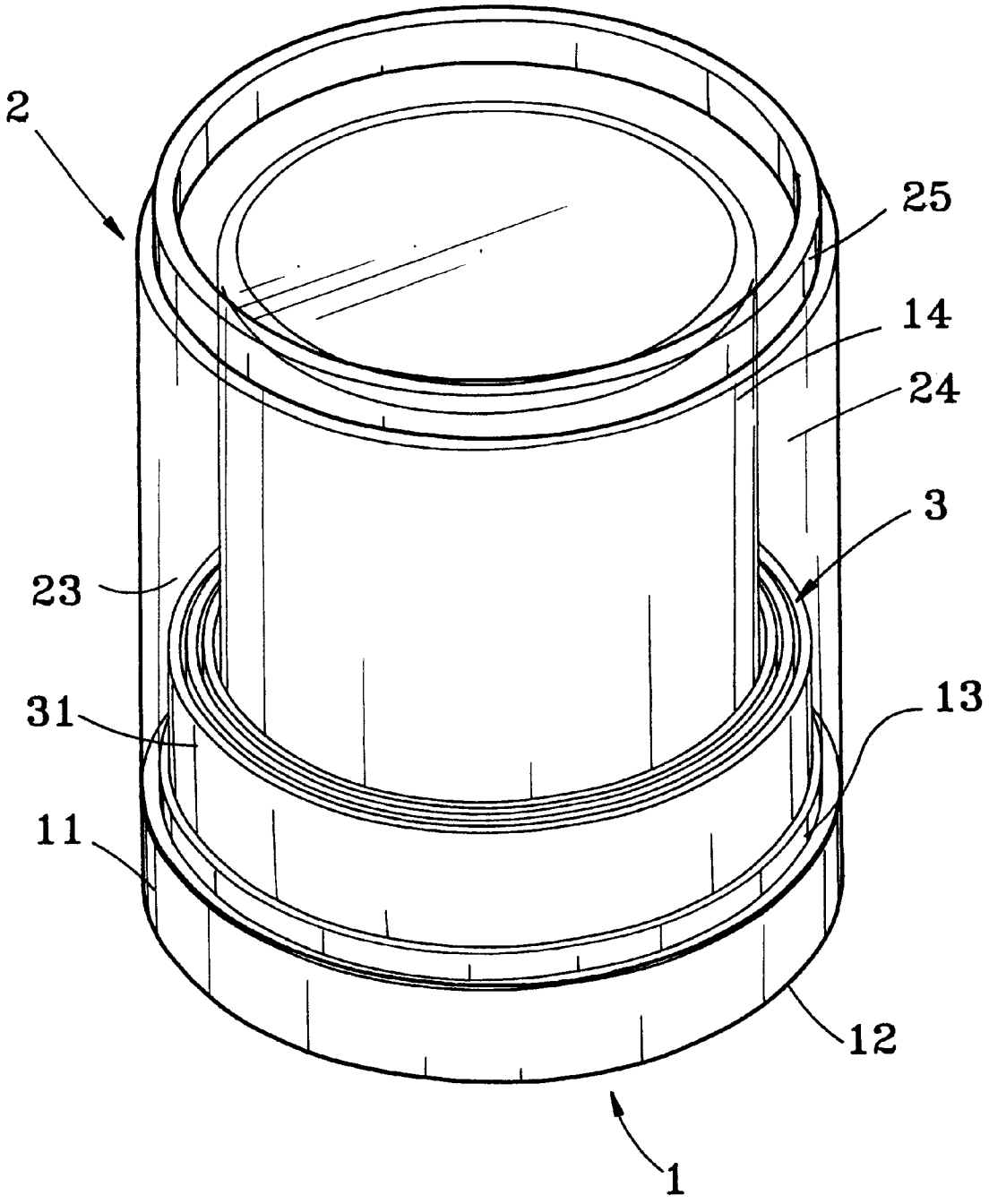
FIG. 1 is a perspective elevational view of a container according to the present invention.
Figure 2:
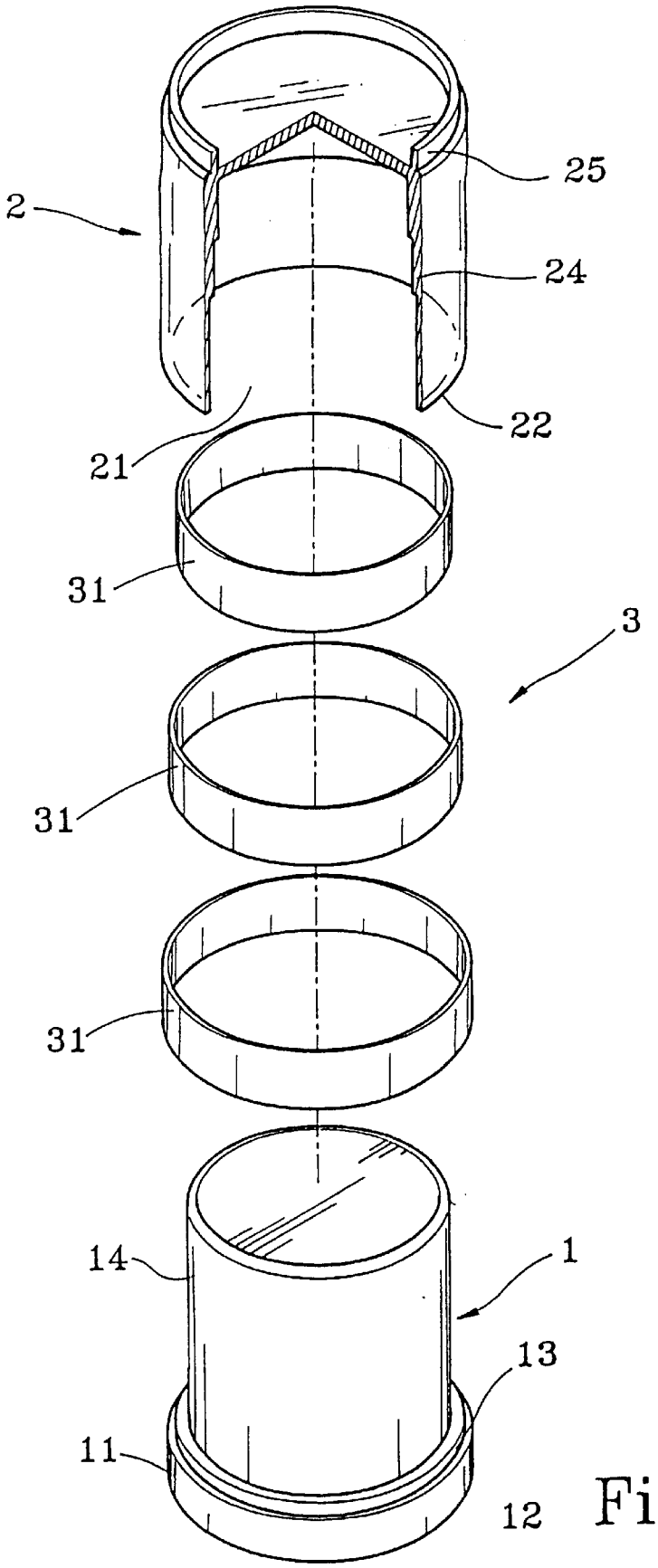
FIG. 2 is an exploded view of the container shown in FIG. 1.

Referring to FIGS. 1 and 2, a container according to the present invention is generally comprised of a container body 1, a shell 2, and a telescopic decorative device 3.

The container body 1 comprises a receptacle portion 14 adapted for holding for example water and defining a top opening 12, a rim 11 raised from the receptacle portion 14 around the top opening, and a stepped coupling portion 13 raised from the periphery of the receptacle portion and downwardly extended from the rim 11. The outside wall of the receptacle portion 14 is decorated with a drawing.

The shell 2 is a hollow transparent device adapted to hold the container body 1 on the inside, having a top opening 21 through which the container body 1 is inserted into the shell 2, a top coupling flange 22 disposed around the top opening 21 and forced into engagement with the coupling portion 13 of the container body 1, a stepped inside wall 24, and an annular foot 25 raised from its bottom side around the border. When the container body 1 is inserted into the shell 2 to force the coupling portion 13 into engagement with the coupling flange 22, a space 23 is defined within the shell 2 around the receptacle portion 14 of the container body 1.

The telescopic decorative device 3 is sleeved onto the receptacle portion 14, comprised of a plurality of decorative rings 31 of different diameters that slide one inside another. The decorative rings 31 are painted with a part of a drawing. When the decorative rings 31 are extended out, they show the whole pattern of the drawing. The shape of the inner diameters of the decorative rings 31 fit the outer diameter of the receptacle portion 14 of the container body 1. For example, they can have a conical or cylindrical shape.

Figure 3B:
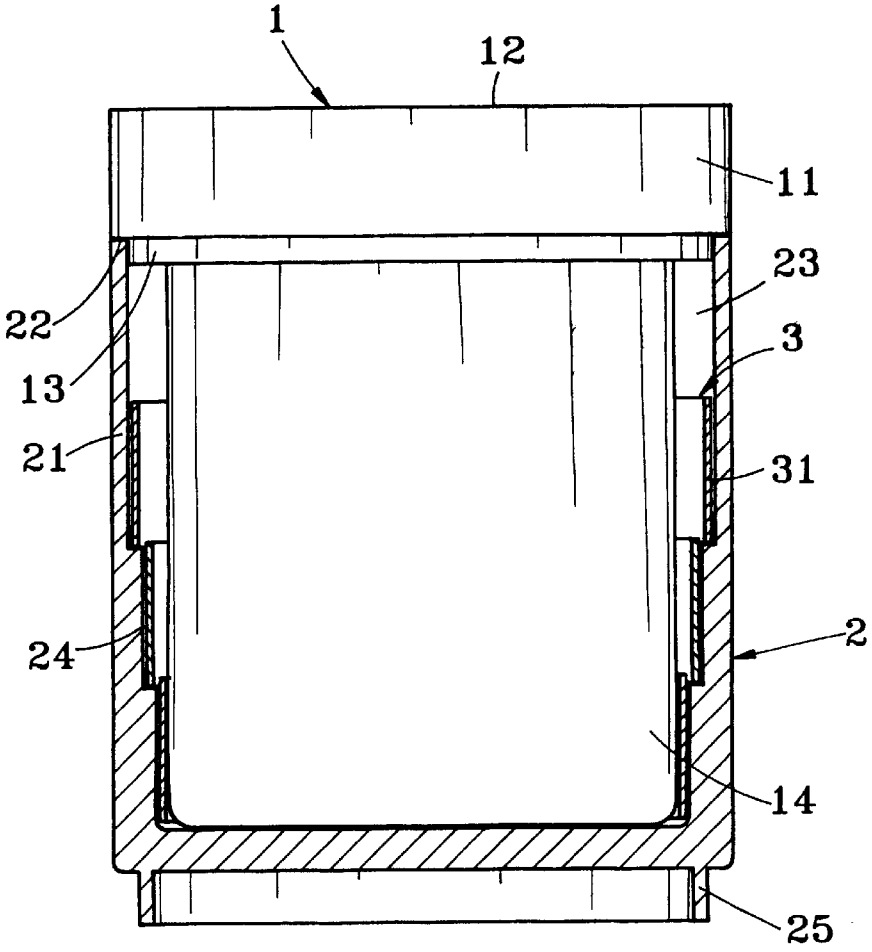
FIG. 3B is a side view in section of the present invention, showing the decorative rings extended out.
Figure 3A:
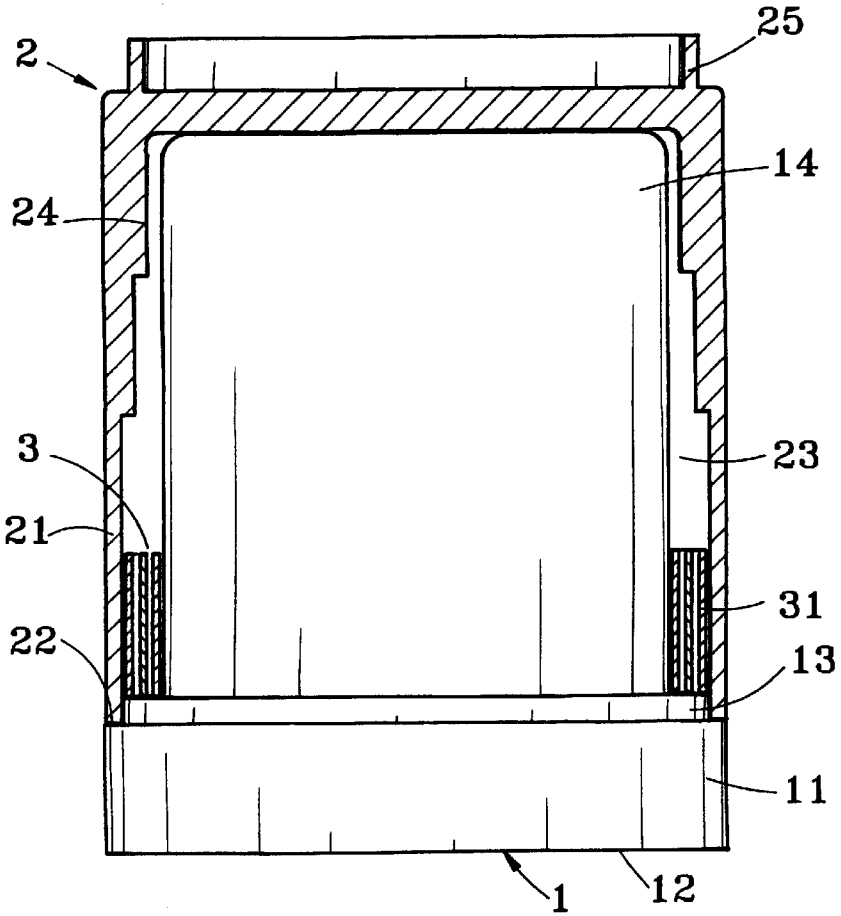
FIG. 3A is a sectional view taken along line A—A of FIG. 1.
Figure 4:
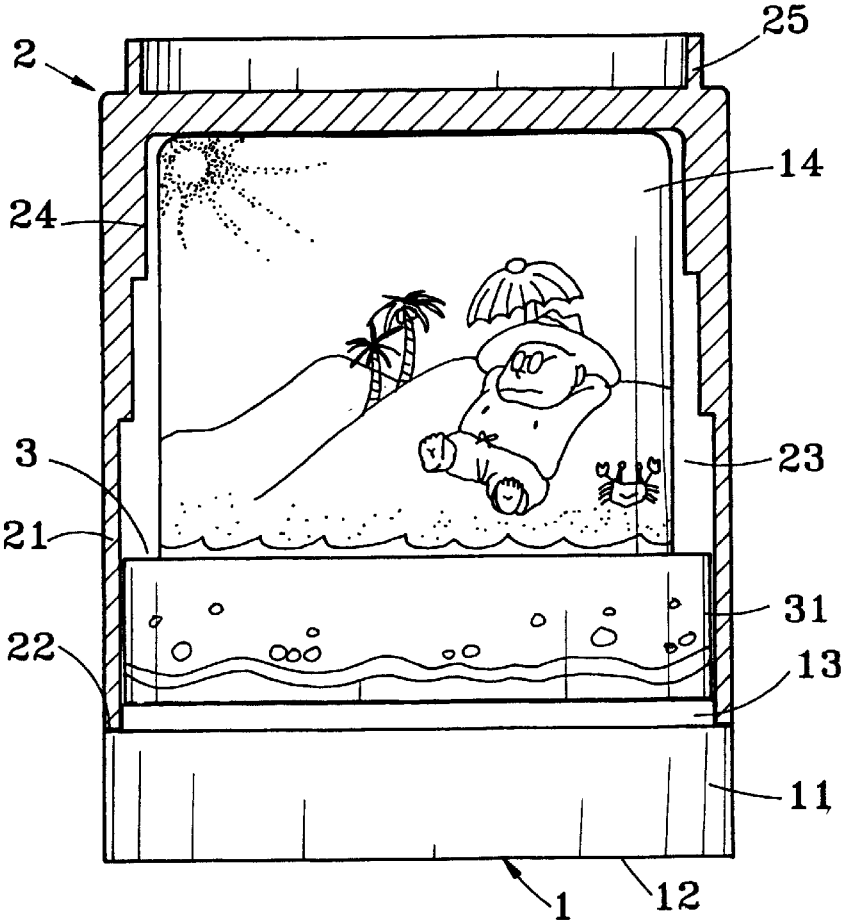
FIG. 4 is an applied view of the present invention, showing the decorative rings received, the drawing of the container body revealed.

Referring to FIGS. 3A and 4, when the container is turned upside down with its top opening 12 facing downwards, the decorative rings 31 fall down in the space 23 with one received in another, and therefore the drawing of the receptacle portion 14 is revealed.

Figure 5:
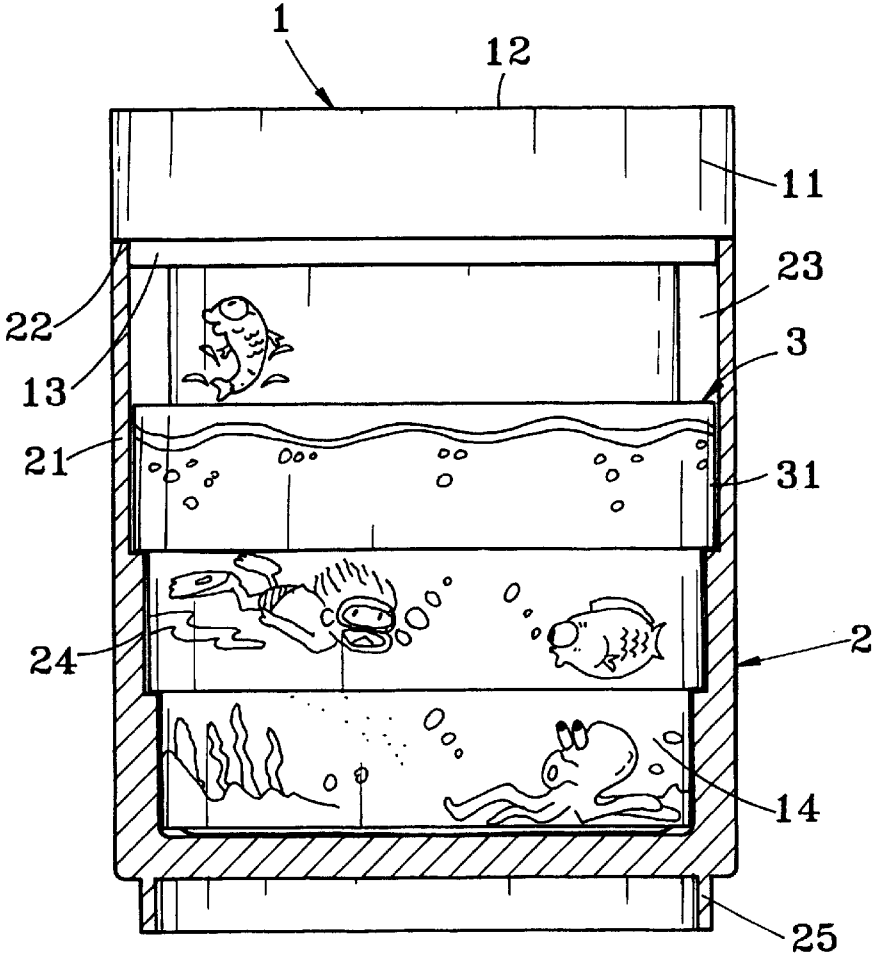
FIG. 5 is another applied view of the present invention, showing the decorative rings extended out and the drawing of the decorative rings shown.

Referring to FIGS. 3B and 5, when the container is in use with its top opening 12 facing upwards, the decorative rings 31 extend out of one another and are supported on the stepped inside wall 24 of the shell 2, therefore the drawing of the receptacle portion 14 is concealed, and the drawing of the decorative rings 31 is shown as a whole.

While only one embodiment of the present invention has been shown and described, it will be understood that various modifications and changes could be made thereunto without departing from the spirit and scope of the invention disclosed.

I claim:

1. A container comprising:

a container body having a receptacle portion defining a top opening, a rim raised from said receptacle portion around said top opening;

a hollow shell sleeved onto said receptacle portion of said container body and defining an enclosed space around said receptacle portion; and a telescopic decorative device mounted around said receptacle portion within said enclosed space and having a plurality of decorative rings that slide one inside another;

wherein the decorative rings of said telescopic decorative device are received one inside another when the container is turned upside down with said top opening facing downwards; the decorative rings of said telescopic decorative device are extended out of one another when the container is disposed in vertical with said top opening facing upwards.

2. The container of claim 1, wherein said container body has a stepped coupling portion raised from the periphery of said receptacle portion and downwardly extended from said rim, said hollow shell has a top coupling flange forced into engagement with the stepped coupling portion of said container body.

3. The container of claim 1, wherein said decorative rings of said telescopic decorative device are respectively painted with a part of a drawing such that the drawing is shown as a whole when said decorative rings are extended out of one another.

4. The container of claim 1, wherein said hollow shell has a stepped inside wall adapted for supporting said decorative rings of said telescopic decorative device when said decorative rings are extended out of one another.

5. The container of claim 1, wherein said receptacle portion of said container body is peripherally decorated with a drawing.

6. The container of claim 1, wherein said hollow shell, said container body and said telescopic decorative device admit light.

7. The container of claim 1, wherein said hollow shell has a foot raised from a bottom side thereof.

8. The container of claim 1, wherein said receptacle portion has a conical shape.

9. The container of claim 1, wherein said receptacle portion of said container body has a cylindrical shape.

* * * * *